US011325049B1

(12) United States Patent
Barrios

(10) Patent No.: US 11,325,049 B1
(45) Date of Patent: May 10, 2022

(54) TOY THEATER TEACHING TOOL

(71) Applicant: William August Barrios, Baton Rouge, LA (US)

(72) Inventor: William August Barrios, Baton Rouge, LA (US)

( * ) Notice: Subject to any disclaimer, the term of this patent is extended or adjusted under 35 U.S.C. 154(b) by 0 days.

(21) Appl. No.: 17/060,348

(22) Filed: Oct. 1, 2020

Related U.S. Application Data

(63) Continuation-in-part of application No. 16/174,673, filed on Oct. 30, 2018, now abandoned.

(60) Provisional application No. 62/580,585, filed on Nov. 2, 2017.

(51) Int. Cl.
*A63H 3/50* (2006.01)
*A63J 19/00* (2006.01)
*A63H 33/04* (2006.01)

(52) U.S. Cl.
CPC ..... *A63H 3/50* (2013.01); *A63H 33/046* (2013.01); *A63J 19/00* (2013.01)

(58) Field of Classification Search
CPC ..... A63H 3/50; A63H 3/52; A63H 33/046; A63H 33/42; A63J 19/00; A63J 19/006
USPC ..... 446/82, 83
See application file for complete search history.

(56) References Cited

U.S. PATENT DOCUMENTS 1,396,046 A * 11/1921 Moore ..... A63H 3/52 446/83
1,502,236 A * 7/1924 Dondo ..... A63J 19/00 446/84
3,422,562 A * 1/1969 Green ..... A63J 19/00 446/83
3,762,788 A * 10/1973 Heller ..... A47B 85/08 312/240
4,075,780 A * 2/1978 Linebaugh ..... A63J 19/00 446/143
4,804,348 A * 2/1989 Bondi' ..... A63H 13/04 446/352
5,261,849 A * 11/1993 French ..... A63J 19/00 446/82
5,275,401 A * 1/1994 Llorens ..... A63F 7/068 273/108.51
5,445,565 A * 8/1995 Setteducati ..... A63J 21/00 472/57
6,056,623 A * 5/2000 Arriola ..... F21V 1/16 446/476
6,663,456 B2 * 12/2003 Gemma, Jr. ..... A63H 3/08 446/147
7,014,524 B2 * 3/2006 Farmer Brock ..... A63H 3/52 446/476
7,749,041 B2 * 7/2010 Leleu ..... A63J 19/00 446/82
8,702,515 B2 * 4/2014 Weston ..... A63F 13/235 463/39
8,808,050 B2 * 8/2014 Goldmeier ..... G09B 19/00 446/82

(Continued)

*Primary Examiner* — Alexander R Niconovich
(74) *Attorney, Agent, or Firm* — Technology and Entrepreneurship Clinic; William David Kiesel

(57) ABSTRACT

A miniature magnetic theater apparatus provides an elevated surface supporting on its upper face (stage) one or more magnetic characters. The characters utilize magnets positioned under the stage for manipulation by a user in accordance with a stage play. Scenery elements may utilize magnets to attach to magnetically receptive drops, wings and a back wall. The drops and wings may be positioned in slotted side beams for positioning and support.

8 Claims, 5 Drawing Sheets

(56) References Cited

U.S. PATENT DOCUMENTS

| | | | | |
|---|---|---|---|---|
| 2010/0255749 | A1* | 10/2010 | Lines | G09B 25/08 446/72 |
| 2019/0126162 | A1* | 5/2019 | Barrios | A63H 3/50 |
| 2019/0143204 | A1* | 5/2019 | Aman | A63F 13/30 463/31 |

* cited by examiner

TOY THEATER TEACHING TOOL

CROSS-REFERENCE TO RELATED APPLICATIONS

This application claims the benefit of priority to U.S. patent application Ser. No. 16/174,673 filed on Oct. 30, 2018 which claims priority to U.S. Provisional application filed on Nov. 2, 2017, Ser. No. 62/580,585 and which is hereby incorporated by reference in its entirety.

BACKGROUND OF THE INVENTION

Field of the Invention

The present invention relates to devices for use as a creativity teaching tool, and more particularly to a toy theater constructed to permit creation of different scenery effects.

Prior Art

Although toy theaters were popular in the $17^{th}$ century and sold as toys in that time, the use of toy theaters has diminished. These prior art toy theaters were constructed with all the scenery pre-painted on stage screen wings and backdrops. This scenery was in stage production. The only creative aspect of these prior art toy theaters was the movement of figures on the stage floor and in changes in the written script of the play that was being read by the actors.

With the costs to fabricate the toy theaters escalating, they could remain cost competitive only if constructed of paper, cardboard, or other cheap wood card stock. Because of this limited functionality and cheap construction, the desire for toy theaters diminished until today, the few remaining are sold to adults as art or novelty items.

There is a continued need in the educational industry for a product that can be used to instruct modern young kids on social and communication skills with other children, spatial skills, collaboration, architecture, critical thinking, trust, memory, social awareness, and problem solving. In addition such products must be sufficiently rugged for use by children, yet safe for young children to handle. It would also be desired if the product was fun and enjoyable for a young person to play.

Objectives of the Invention. It is one objective of this invention to construct a toy theater that can be used to instruct modern young kids social and communication skills with other children, spatial skills, collaboration, architecture, critical thinking, trust, memory, social awareness, and problem solving.

Another objective of this invention is to construct a kit including a theater stage and multiple pieces that a young child can use to add scenery to the stage.

Still another objective of this invention is to provide scenery pieces that are sturdy and rugged.

A still further objective of this invention is to provide a theater stage and multiple scenery pieces designed to create a visual image on the stage based on a theme.

A still further objective of this invention is to provide a theater stage to which can be added wings and backdrops for scenery pieces to be attached.

A still further objective of this invention is to provide a theater stage kit suitable for modern children.

A further objective of this invention is to provides modern children with a modern, durable toy theater that uses a magnetic system of interchangeable surfaces and magnetically-based characters, scenery and props to design, produce and put on a stage show.

A further objective of this invention is to provide a toy theater kit having one or more magnetically-based characters having a corresponding magnetic disc that may be used to manipulate the characters around the stage floor.

These and other objectives of this invention shall become apparent from the ensuing descriptions of the invention.

SUMMARY OF THE INVENTION

In one aspect of the invention, a toy theater kit is provided comprising a toy theater having a stage panel, a front panel extendable vertically from the stage panel and a rear panel also extendable vertically from the stage panel, two support beams spanning between the front and rear panel to support one or more scenery screen wings and/or drops, and multiple scenery props magnetically fixable and removable to and from the front panel, the rear panels, and the scenery screen wings and/or drops to create different visual imagery on the stage.

In a preferred embodiment the toy theater stage kit further comprising one or more magnetic characters constructed to stand on the stage panel and to be manipulated for movement of the character around the stage panel by a corresponding magnetic disc manipulator affixed to an elongated rod positioned below the stage floor. The magnets are sufficiently strong, and the stage floor materially sufficiently thin and magnetically permeable to allow for this type of "hidden" manipulation of the characters by the user.

In another preferred embodiment the front and rear scenery panels, as well as the scenery screen wings and drops have magnetic surfaces extending across at least one of their entire vertical surfaces.

These and other features, aspects and advantages of the present invention will become better understood with reference to the following drawings, description and claims.

PREFERRED EMBODIMENTS OF THE INVENTION

Figure 1:
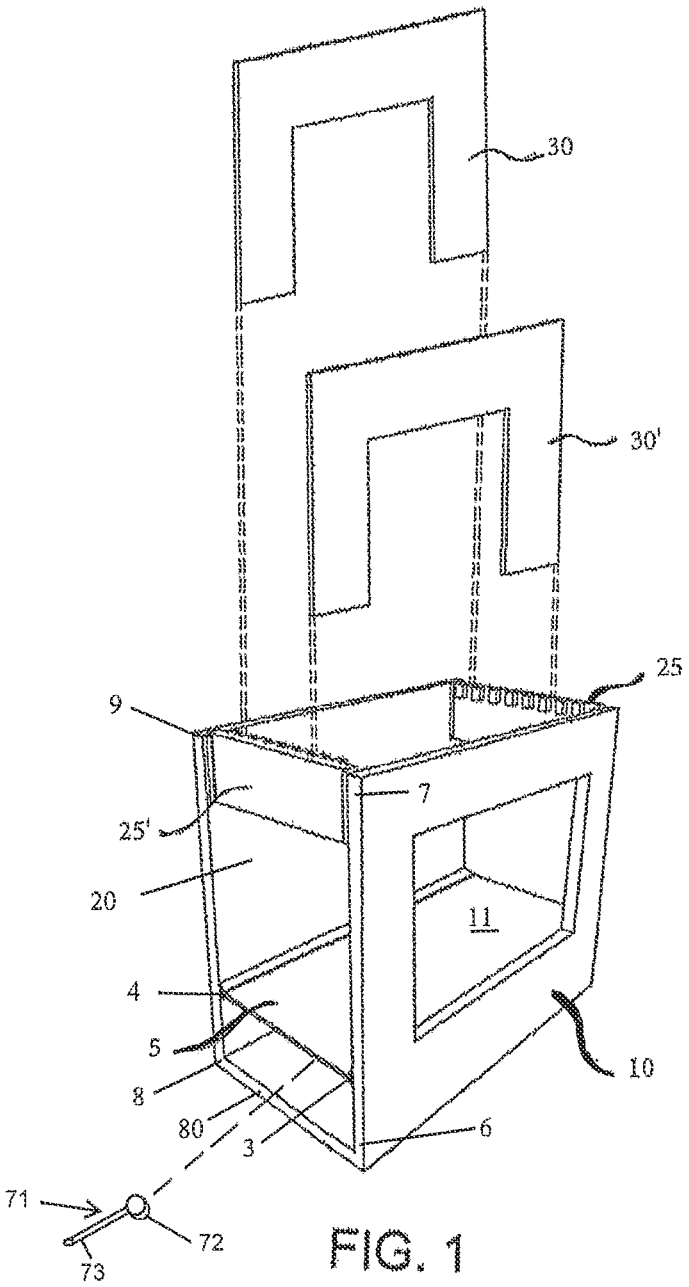
FIG. 1 is a partially exploded perspective view of a preferred embodiment of the present invention.

The above described drawing figures illustrate the invention. FIG. 1 shows a preferred embodiment of the present invention miniature magnetic theater apparatus 1, made of materials safe for child handling and consumption that can withstand prolonged use such as, but not limited to, durable wood, plastic, metal, Teflon®, nylon fiber, high quality plastic, or some combination of these or similar materials. The theater 1 comprises an elevated stage panel 5 with an area 4 under the stage panel 5 creating a cavity 80 sized for permitting a child to move one or more magnetic manipulators 71 (such as illustrated in FIG. 1) in cavity 80 under the stage panel 5. Character 60 includes a magnet responsive to a manipulator 70.

The preferred embodiments illustrate a toy theater 1 that is rectilinear in shape with a rectilinear stage panel 5 and opposing front panel 10 and rear panel 20 having substantially equivalent geometries. However, the invention is not limited to this shape and geometry. For example, the stage panel 5 could be a trapezoid broadening from back to front resulting in opening the perspective of the stage to the audience with the front panel 10 and rear panel 20 accommodating the geometry.

In FIG. 1, the front panel 10 has stage window 11 creating a view of the stage panel 5, rear panel 20, wings 30, drops 40, and other scene modifiers, props, as well as characters 60, and adornments that accompany a preferred embodiment of the invention. In a preferred embodiment, stage window 11 can be maximized within front panel 10 to show the entirety of the stage. In another preferred embodiment, stage window 11 in front panel 10 may be varied in size to focus the audience's attention upon a particular narrow or broader view of the stage for dramatic effect.

Figure 2:
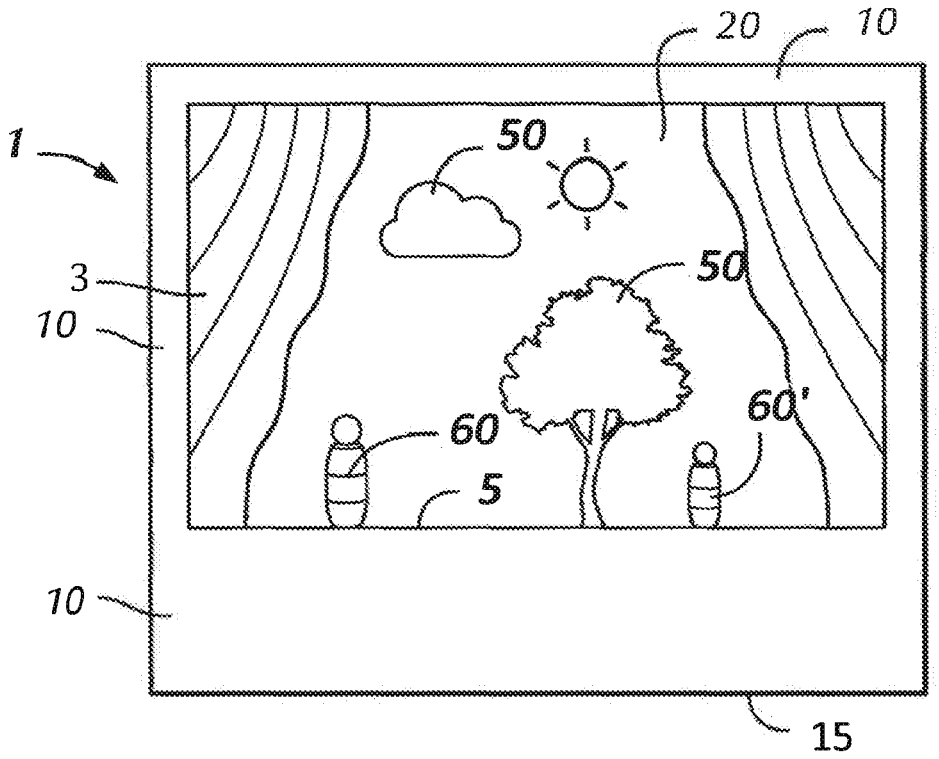
FIG. 2 is a front panel elevation of a preferred embodiment of the present invention.

Characters 60 are shown on the stage in FIG. 2. Scenery elements 50 are also shown, and may be attached to various surfaces of the invention using magnets. In a preferred embodiment, the scenery elements 50 may magnetically attach to stage components including stage panel 5, front panel 10, rear panel 20, side beam 25, wing 30 or drop 40. The scenery element 50 may consist of trees, house, sky, clouds, castles, bricks, etc. The scenery element 50 may be cut to the exact shape of the illustration, leaving little to no border assuring seamless visual aesthetics.

A magnet material may be used, such as a sheet magnet or any other form of magnet that provides for a consistent magnetic field, to magnetize either or both scenery elements 50 and stage components 10, 20, 25, 30, 40. If only one of scenery elements and stage components consists of sheet magnet material, then the other must consists of a magnetically responsive material, such as a magnetic metal, responsive to the magnetic material. In a preferred embodiment, all of these components are magnetic, which ensures that any scenery element 50 may be attached to any other element 50 or stage components 10, 20, 25, 30, 40 by the user. This configuration also allows for layering of elements, as will be explained below.

Figure 3:
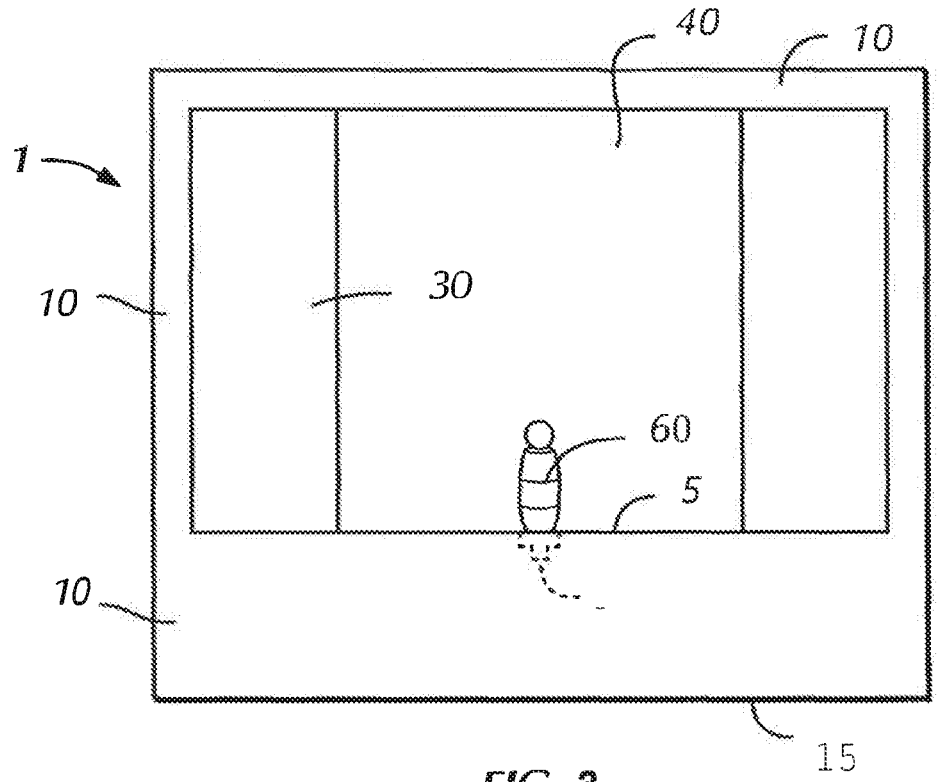
FIG. 3 is another front panel elevation of a preferred embodiment of the present invention.

FIG. 3 shows the theater 1 with a wing 30 and drop 40 in place. These components are positioned between the front panel 10 and rear panel 20 (not visible in FIG. 3, because of the drop 40). A wing 30 has at least one vertical component that extends into the stage area, but a wing 30 leaves most of the stage panel 5 unobstructed. Using at least one wing 30, a user can enrich the scene by adding scenery elements 50 and a sense of depth. In addition, by reducing the visible stage area, a wing 30 can draw more attention to the actions presented.

Drop 40 is a solid vertical component, essentially a wall that completely covers the stage area. The drop 40 in FIG. 3 is positioned behind wing 30, so that the drop 40 effectively becomes the backdrop of the scene. In preferred embodiments, both wing 30 and drop 40 include magnetic material or magnetically responsive material so that scenery elements 50 may be easily attached to wings 30 and drops 40.

In a preferred embodiment, the invention includes a number of wings 30, 30', 30" and drops 40, 40', 40", which may include ornamental designs appropriate for particular scenes in a play or musical. For example, wing 30 may be made to look like the inside walls of a castle or parts of a forest. Drop 40 may show a variety of backgrounds, including vistas of natural scenes, or the back walls of a room. By providing a number of preconfigured wings and drops, the user is given a great deal of creative flexibility. Furthermore, wings 30, drops 40 or magnetic scenery elements 50 may also receive LED lights that will wrap around the outer edges, or be house within the material. The LED lights will connect to the toy though Bluetooth, wireless internet or other wireless internet capabilities between the two devices. The LED lights will allow for the user to turn the lights on the wings 30, drops 40 or scenery off and on, or activate a multi-colored color show. At least one basic wing 30 and drop 40 may also be provided, that is, with blank surfaces.

Figure 8:
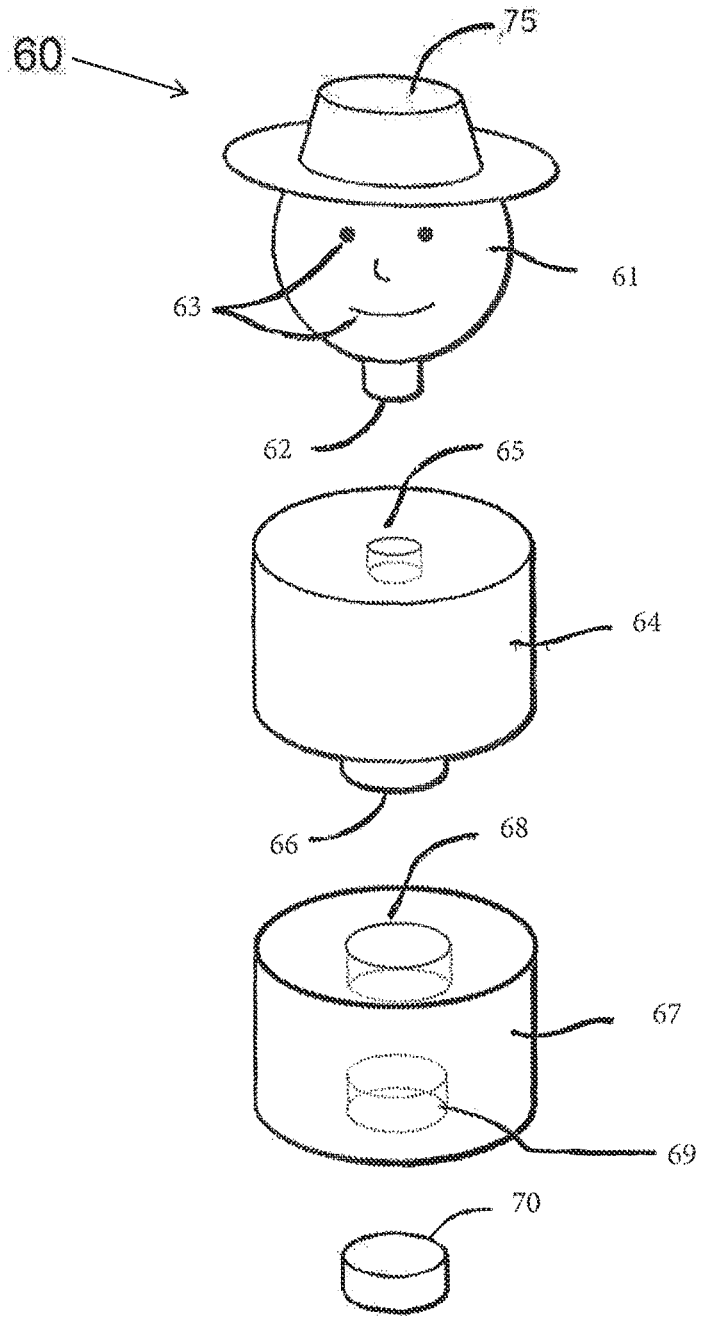
FIG. 8 is a view of a character showing a tabs and slot means for connecting the multiple parts of said character and a magnet for manipulating said character.

A character 60 such as shown in FIG. 8 can be positioned on the stage panel 5 as shown in FIGS. 2 and 3. Under the stage panel 5 is the magnetic controller/manipulator 50/71. Manipulator 71 includes a magnet 72 affixed to a handle 73 that is easily manipulated by a child. The manipulator 71 is accessed by the user from the cavity area under the stage panel 5. Movement of the manipulator 71 along the bottom surface of the stage panel 5 causes the character 60 to move in the same direction along the top surface of the stage panel 5. This operation requires that the stage panel 5 be thin and/or sufficiently magnetically permeable to allow the magnetic manipulator 71 to reliably interact with and move the character 60.

Figure 4:
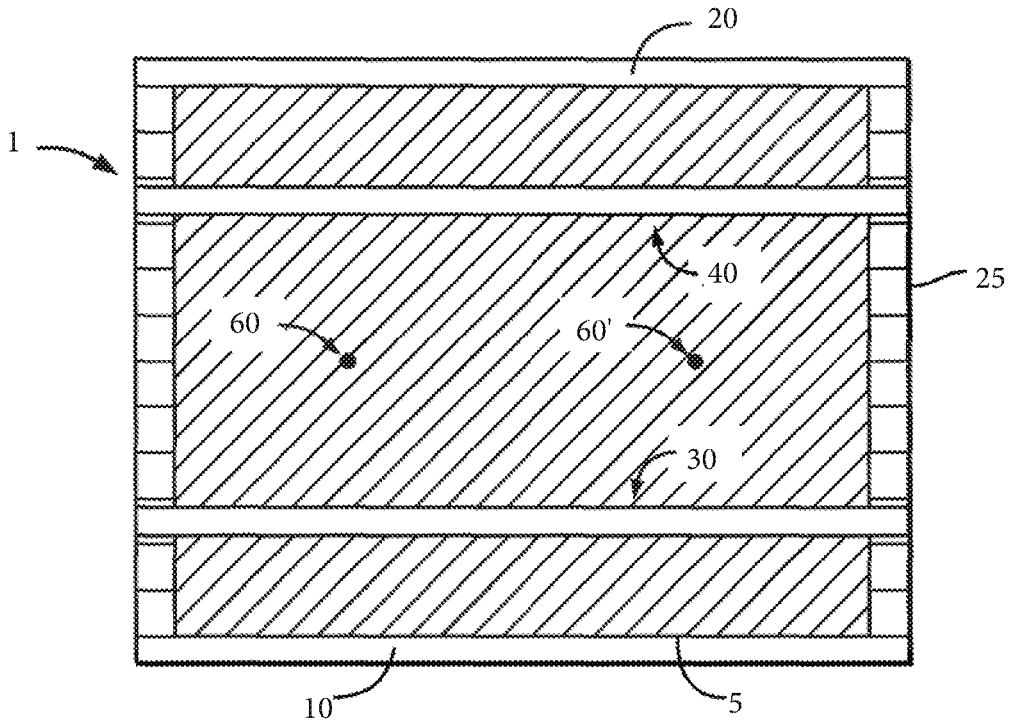
FIG. 4 is a top down elevation of a preferred embodiment showing scene modifiers supported by at least one beam.
Figure 5:
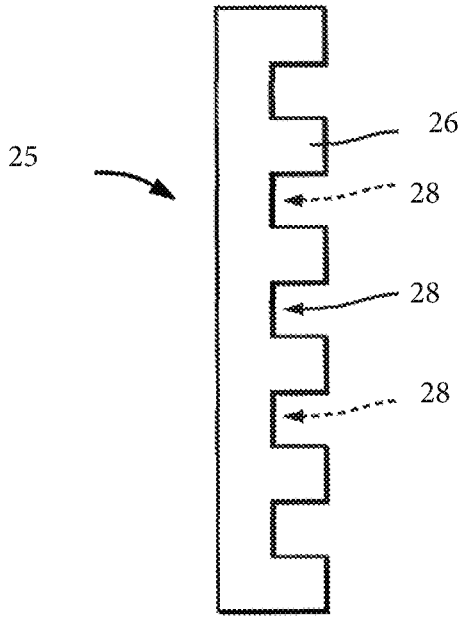
FIG. 5 is a perspective of a beam of a preferred embodiment of the present invention.

The relative positioning of multiple wings 30 and 30' is shown in FIG. 1 and the relative positioning of wing 30 and drop 40 is shown in FIG. 4. In FIG. 4, the stage panel 5 is seen here from above, and the wing 30 can be seen positioned in front of the drop 40 and the rear panel 20. Beam 25 supports wings 30 and 30' and drop 40. In a preferred embodiment, beam 25 includes protrusion 26 and slot 28 to support wings 30 and 30' and drop 40 as depicted in FIG. 5. Protrusion 26, slot 28 and the peripheral edge of either wing 30 or drop 40 are configured such that the peripheral edge of either wing 30 or drop 40 is supported by beam 25. There are numerous configurations in the prior art to reach this end.

The drop 40 is a solid piece in the preferred embodiment, whereas the wing 30 includes a major opening. Either wing 30 or drop 40 may include minor openings representative of a door, window, or other type of opening.

Figure 6:
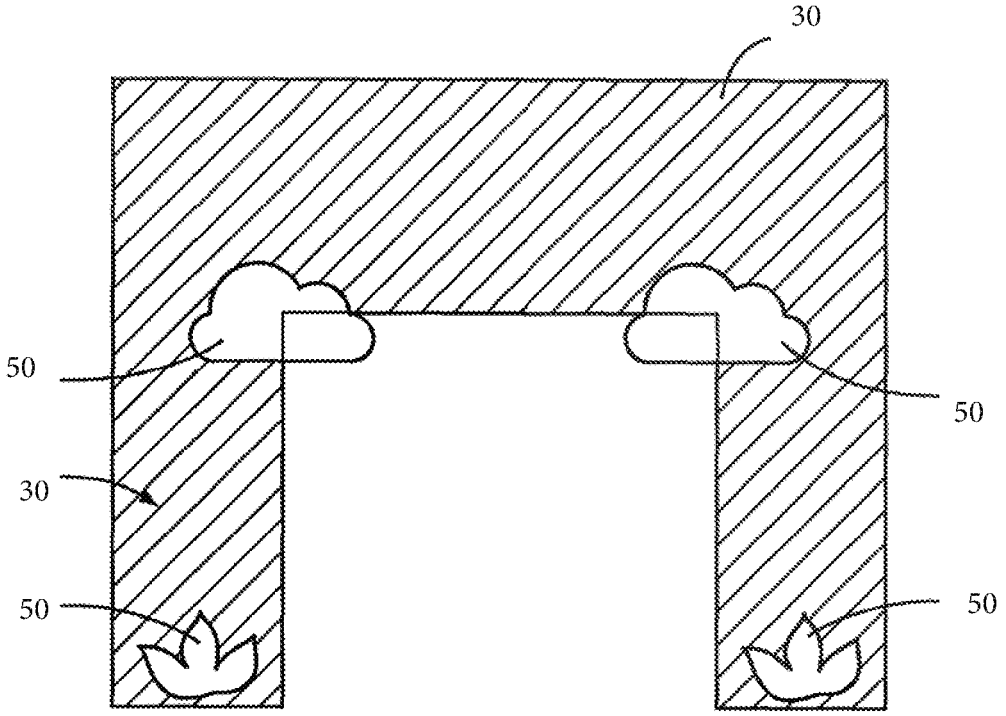
FIG. 6 is a view of a wing to be supported by a beam of a preferred embodiment.
Figure 7:
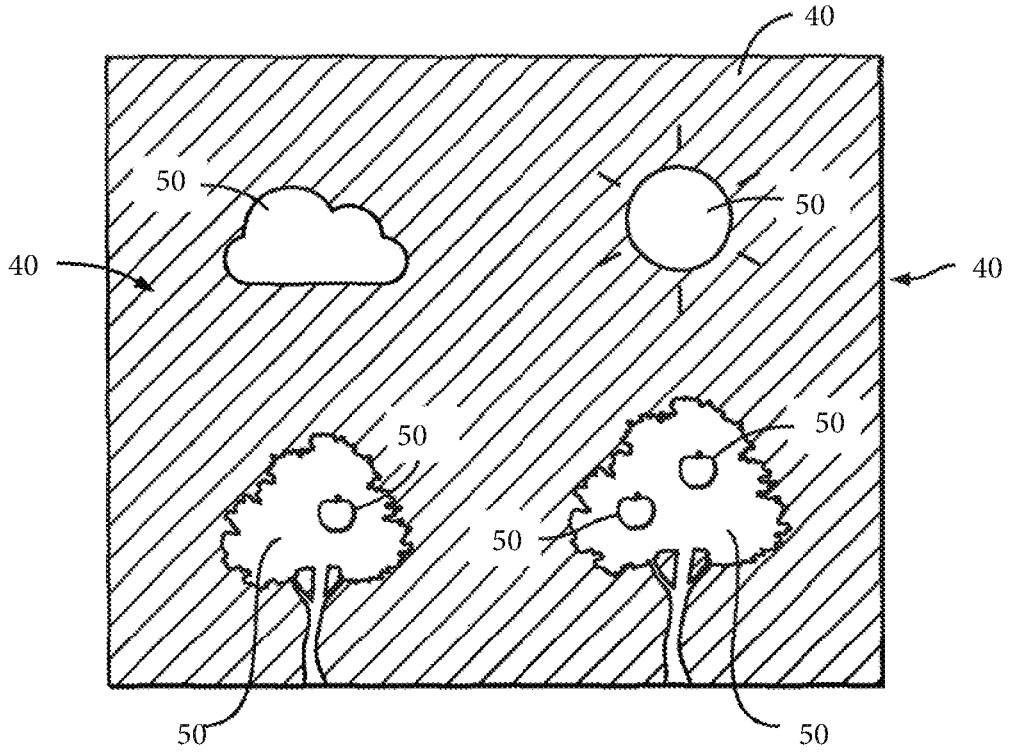
FIG. 7 is a view of a drop to be supported by a beam of a preferred embodiment.

Typical examples of a wing 30 and drop 40 are shown in FIGS. 6 and 7, respectively. In a preferred embodiment, wing 30 and drop 40 are magnetic, for example, through use a magnetic sheet material. Scenery elements 50 are shown attached to the wing 30 and drop 40. The scenery elements 50 are also magnetic in a preferred embodiment, but these items can be merely magnetically attracted to the magnetic surfaces of the wings 30 and drops 40. This characteristic of the invention allows for easy application, repositioning, and removal of scenery items 50 by a user. Scenery elements 50 may extend beyond the edges of a wing 30, as the scenery element depicting a cloud does in FIG. 6.

FIG. 7 depicts an added benefit of the magnetic interactions. Two scenery elements 50 depict trees, and further scenery elements 50 depict apples magnetically layered on each tree. The ability to layer scenery items greatly increases the options for the user. It is also possible to attach scenery elements 50 to the back of a wing 30 so that only the parts extending beyond the edge of the wing 30 are visible to the audience. This is another form of layering that can be done with the present invention.

A typical character 60 is shown in more detail in FIG. 8. There are three sections of this character 60: a head 61, torso 64, and base 67. The head 61 may have features 63, such as eyes, nose, and mouth, as in FIG. 8. In a preferred embodiment, accessories 75 such as hats are removeable increasing the number of characters that may be represented and the number of ways to represent individual characters.

The body parts are connected in this embodiment using peg and cavity features. The head 61, for example, has a small, cylindrical peg 62 that is sized to fit into the cylindrical cavity 65 on the upper side of the torso 64. A slightly larger cylindrical peg 66 extends from the lower side of the torso 64, and is sized to fit within a corresponding cylindrical cavity 68 on the upper side of the base 67. These parts may be secured together to form a unitary character 60. Alternatively, the magnetic character 60 may be interconnected using magnets. If magnets are used to connect the sections of the character 60, the magnets would essentially replace the cavity and peg structure described above.

The base 67 has a recess 69 into which a base magnet 70 can be fitted in its lower side. The magnetic manipulator 71 is sized to be positioned below the stage panel 5 within cavity 4 and positioned directly beneath the character 60, thus allowing the magnetic manipulator magnet 72 to engage with the character base magnet 70. These magnets are sufficiently strong to provide a secure bonding connection, thus allowing the user to move the character 60 around the stage panel 5 by moving the magnetic manipulator 71 under the stage panel 5, all being outside the view of the audience.

The character 60 is shown in unadorned fashion, but it should be understood that any variety of designs could be applied to the head 61, torso 64, and/or base 67. Some may be clothed, and others not. Some may be made to simulate humans, other animals, plants, buildings, or almost anything else. And by making the characters 60 in this multi-piece form, a user can mix and match different character pieces to create even more options. Want a tree trunk with a human head? Want a bear's head on a flower stalk with a standard base? There are truly no limits to what a child can do with this type of design. The character 60 shown in FIG. 8 is made of three sections, but this is only to illustrate a preferred embodiment. Characters with two sections or four or more sections may be used. And single piece characters also may be used. All of these variations are within the scope of the invention disclosed here.

In the most preferred embodiment, the recessed character base magnet 70 and the manipulator magnet 72 are to have well-defined poles which will align with the opposed pole of the other magnet. This feature allows the character 60 to be aligned securely with the manipulator magnet 72. That means a user can be sure of the alignment of the character 60 without having to see it. For example, the manipulator magnet 72 may include some noticeable marking such as a raised dimple or a visible mark to indicate orientation, which would indicate the orientation of the character 60; i.e., which direction the character 60 is facing.

This alignment of opposed magnet poles allows the user to easily control characters 60 in a play. For example, two characters 60, 60' speaking will normally face each other, and the user can easily accomplish this from below the stage using this feature of the invention. The user can also turn characters 60, 60' during a scene when needed, for example, when turning to leave a room. All of these actions can be performed by a hidden user, who doesn't need to even see the actual characters 60, 60' during the scene.

At least one slotted beam 25 spans the top of front 10 and rear panel 20. In a preferred embodiment, at least one slotted beam 25 spans the top of front 10 and rear panel 20 on stage right, and at least one slotted beam 25' spans the top of front 10 and rear panel 20 on stage left 25'.

These beams 25, 25' include uniform slots 28 receptive of wings 30 and drops 32. Slots 28 are defined by uniform protrusions 26 on beams 25, 25' and slots 28 on beam 25 align with slots 28 on beam 25'. The slots 28 may receive some type of identifying mark such as a color, letter, or image to codify the aligned slots 28 between beam 25 and beam 25'. This will help the child insert the wings 30 and drops 32 into the correct slot 28 in beams 25, 25'. In a preferred embodiment, beams 25, 25' or in another preferred embodiment slots 28 are magnetic such that they are magnetically responsive to the magnetic properties of wings 30 and drops 40.

Wings 30 and drops 40 have the same width as the distance between the inside of each slot 28. Wings 30 and drops 40 may be taller than either the front 10 or rear panel 20, which allows a child to grip the wings 30 and drops 40 for insertion and removal. Wings 30 and drops 40 may contain a scenic representation that is printed on the surface, but may also be made of vinyl or white board like surface, which allows a child to draw with marker, paint, pen, or other writing instrument so that a child can create its own illustrations.

Drops 40 are generally a solid panel, but may include minor openings representative of doors, window, or natural openings such as caves or gopher holes. Wings 30 include a solid panel portion and a major opening. The panel portion reduces the visible area of the stage panel 5 and adds depth to the scene as seen in FIG. 3. The major opening allows character 60 to traverse between the front and rear of the stage panel 5. However, it should be understood that the description of drops and wings are general and that there is a broad range of creative possibility between the two descriptions that may be used to build a scene. Drop 40 and wing 30 may further include a space for a smartphone or tablet to be enclosed and become included in the performance by providing audio stimulus, visual stimulus, or a combination of both to enhance the performance.

In a preferred embodiment, drops 40 and wings 30 magnetically interact with magnetic scenery elements 50. A means to encourage magnetic relationship is done via the magnetic sheet material, such as rubber, steel, iron, or sheet magnet with a multi-pole surface such as Ultra-mag material (i.e., a commercially available product). A multi-pole magnetic sheet material allows for a reliable amount of north/south poles, allows scenery element 50 to stay attached where the user intends to attached the scenery item to either wings 30 or drop 40, and allows the user to layer scenery elements 50 on either wings 30, drop 40, and/or other scenery elements 50. In a preferred embodiment, wings 30, drops 40 and magnetic scenery elements include a multi-pole magnetic sheet material.

Preferably the apparatus further comprises a magnetically enhanced curtain 3 engaged with the magnetically receptive front panel 10 as shown in an open configuration in FIG. 2, for viewing the magnetic characters 60, 60' and the scene, and alternatively may be manipulated to a closed configuration, not shown, for inhibiting such viewing.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A miniature magnetic theater for use as a creativity teaching tool, comprising:

a magnetically receptive vented front panel having a bottom end and a top end;

a magnetically receptive rear panel having a bottom end and a top end;

a bottom panel fixed between the bottom end of the front panel and the bottom end of the rear panel;

a stage panel fixed between the front panel and the rear panel at a position above the bottom panel, the stage panel having a top surface for supporting at least one magnetic character comprising a base magnet having a well-defined magnetic pole;

wherein the bottom panel, the stage panel, the front panel and the rear panel form a cavity sized to permit using a magnetic manipulator comprising a magnet having a well-defined magnetic pole positioned within the cavity and aligned with the well-defined magnetic pole of the base magnet to cause movements of a character positioned on the top surface of the stage panel;

a first beam and a second beam, each beam having multiple slots and fixed between both the top end of the front panel and the top end of the rear panel; wherein the multiple slots of the first beam are alignable to the multiple slots of the second beam to facilitate a stage drop and/or wing to be hung from a pair of the aligned slots;

the stage drop and/or wing being constructed from a magnetic material providing a consistent magnetic field across a surface of the drop and/or wing; and at least one scenery element constructed having a desired design and magnetically removably attachable to the stage drop and/or wing.

2. The miniature magnetic theater according to claim 1, wherein said slots maintain a width of 0.5 to 1.5 cm.

3. The miniature magnetic theater according to claim 1, further comprising:

a magnetically receptive drop that is adhesive to magnetic material, used with magnetic characters, and slides between said slots.

4. The miniature magnetic theater according to claim 1, further comprising:

a magnetically receptive wing that is adhesive to magnetic material, used with magnetic characters, and slides between said slots.

5. The miniature magnetic theater according to claim 1, further comprising:

the magnetic characters being constructed from multiple interchangeable components enclosing magnets having a well-defined magnetic pole that aligns with a well-defined magnetic pole of the manipulator magnet.

6. The miniature magnetic theater according to claim 1, further comprising:

at least one magnetic manipulator positioned below the stage panel top surface used to move by manipulation, the magnetic characters positioned on the stage panel top surface.

7. The miniature magnetic theater according to claim 1, further comprising:

the at least one scenery element that is magnetically attachable to the drop constructed from a magnetic material, or the wing constructed from a magnetic material.

8. A toy theater kit comprising a toy theater stage having a stage floor wherein a front scenery panel and a rear scenery panel are extendable vertically from the stage floor and being constructed from a magnetic material providing a consistent magnetic field across a surface of the front scenery panel and the rear scenery panel;

a first beam and a second beam, each beam having multiple slots fixed between both a top end of the front scenery panel and a top end of the rear scenery panel; wherein the multiple slots of the first beam are alignable to the multiple slots of the second beam to facilitate a stage drop and/or wing to be hung from a pair of the aligned multiple slots; the stage drop and/or wing being constructed from a magnetic material providing a consistent magnetic field across a surface of the drop and/or wing; and multiple scenery elements magnetically fixable and removable to and from the front scenery panel, the rear scenery panel, and the stage wing and/or drop to create different visual imagery on the stage; and one or more magnetic characters constructed to stand upright on the stage floor and be manipulated for movement about the stage floor by a corresponding magnetic disc affixed to an elongated rod positioned below the stage floor.

* * * * *